US006176690B1

(12) United States Patent
Knepp

(10) Patent No.: US 6,176,690 B1
(45) Date of Patent: Jan. 23, 2001

(54) OPTIMALLY DAMPENED SEPARABLE ENGINE-COMPRESSOR

(76) Inventor: John Evans Knepp, 1750 Hartwright Rd., Vista, CA (US) 92084-7632

( * ) Notice: Under 35 U.S.C. 154(b), the term of this patent shall be extended for 0 days.

(21) Appl. No.: 09/374,292

(22) Filed: Aug. 16, 1999

(51) Int. Cl.[7] ..... F04B 17/00
(52) U.S. Cl. ..... 417/359; 417/364; 417/312; 123/198 E
(58) Field of Search ..... 417/123, 364, 417/363, 362, 454, 361, 360, 349, 571, 237; 123/1 R, 192, 2, 198 E

(56) References Cited

U.S. PATENT DOCUMENTS

| | | | | |
|---|---|---|---|---|
| Re. 13,645 | | 11/1913 | Stone . | |
| 2,133,769 | | 10/1938 | Jones . | |
| 3,462,074 | | 8/1969 | Grimmer . | |
| 4,391,568 | | 7/1983 | Tenney . | |
| 4,700,663 | | 10/1987 | Dunn . | |
| 4,961,691 | * | 10/1990 | Waldrop | 417/237 |
| 5,267,843 | | 12/1993 | Waldrop . | |
| 5,400,751 | | 3/1995 | Grimmer . | |
| 5,467,747 | * | 11/1995 | Brandt et al. | 123/198 E |
| 5,865,087 | * | 2/1999 | Olson | 91/497 |
| 5,873,708 | * | 2/1999 | Delhomme, II et al. | 417/312 |
| 5,997,259 | * | 12/1999 | Marshall et al. | 417/349 |

OTHER PUBLICATIONS

Jake Elliott; Early Warning of Vibration Problems Can Protect Against Catastrophic Loss; CompressorTech; Mar./Apr. 1998, p. 60.

Joe Kane; Several Hundred Eagle Compressors in Prodution Field–Gas Gathering and Booster Applications; CompressorTech; Mar./Apr. 1998, p. 22.

* cited by examiner

*Primary Examiner*—Teresa Walberg
*Assistant Examiner*—Jeffrey C Pwu
(74) *Attorney, Agent, or Firm*—George T. Parsons

(57) ABSTRACT

The present invention is a separable driver-compressor combination with minimal modifications to incorporate a high production block design. One block is used for the driver engine which is appropriately modified to operate using various fuels. The other block is modified to incorporate crossheads and cylinders with several unique sealing and connecting features. The drive mechanism between the engine and the compressor has several embodiments providing a driver engine to compressor selectable speed ratio and optimizing operating performance. The compressor design incorporates a modular cylinder assembly construction technique. The dampening mechanism dampens out vibration energy eliminating the need for large mass compressor packages required by current design practice. This unique dampening system results in a smaller and lighter compressor package which will transmit extremely low levels of vibration to the base support structure without any performance penalties.

44 Claims, 7 Drawing Sheets

OPTIMALLY DAMPENED SEPARABLE ENGINE-COMPRESSOR

BACKGROUND OF THE INVENTION

1. Field of the Invention

The present invention relates generally to power convertors, and more particularly to a separable engine and gas compressor. The engine-compressor is optimally dampened so as to provide a compact, lightweight, easily repairable unit.

2. Description of the Related Art

The compressor field includes many different inventions which have attempted to combine a power driver, such as an automotive engine or virtually any other engine, including an electric motor, with a compressor, such as a gas compressor, to compress gas. More specifically, these engine-compressor combinations have been either integral or separable. An integral combination means that the engine and compressor are built as one unit by using a common crankshaft connected to pistons that provide drive power or compress gas. Some current manufacturers of the integral design include Ajax, Hurricane and Gas Jack. A separable combination is one that physically separates the power driver or engine from the compressor. The power driver and compressor are joined together by a system of components to allow their functioning together. Separable compressors are the most widely used in the natural gas gathering industry. Ariel and Gemini are two large manufacturers of separable natural gas compressors. Typically the engines used in the separable natural gas design are provided by Caterpillar or Waukesha.

Separable designs do have the nominal advantage of being easier to repair than the integral design. One reason for easier repair is that the power can be separated from the compression function. In addition, the separable design allows for easier power-to-load matching from the engine to the compressor. A separable compressor can also be driven by an electric motor.

Prior art has a long list of problems and disadvantages which the present invention has overcome. One disadvantage in the design of all known previous long-life continuous duty driver-compressor combinations has included a relatively large footprint, necessitated by the massive weight to control vibration. Another disadvantage of the current prior art design is the difficulty in repairing or replacing either the compressor or the driver functions. With any system shutdown, lengthy downtime is experienced because of the required disassembly of much of the structure to isolate the cause of the breakdown. Then additional lengthy delay is typically experienced because the needed part is uniquely designed, thereby requiring even more time to build and ship. Also, the massive weight and design complexity prevent easy portability and use in less-developed countries.

Therefore, it is clear that a need exists in gas compressor markets for an improved separable power driver-compressor combination that is easily and quickly repairable, lightweight, and has a small footprint. The present invention overcomes all these long standing problems and disadvantages of the prior art.

Some of the prior art includes the following U.S. patents. These patents describe converted automobile engines. Jones U.S. Pat. No. 2,133,769, discloses an air compressor based on the V-8 configuration of an automobile engine. This configuration discloses one bank of cylinders as the compressor function and the second bank of cylinders as the driver function. Grimmer U.S. Pat. No. 3,462,074, and Waldrop, U.S. Pat. No. 5,267,843, also disclose integral configuration air compressor designs in which one bank of four cylinders is used for the driver function and the other bank of cylinders is used for air or gas compression.

Dunn, U.S. Pat. No. 5,267,843, discloses an integral air compressor based on a Volkswagen four cylinder horizontally opposed automotive engine. The Dunn compressor is also a low pressure single stage compressor. The Caldwell U.S. Pat. No. 5,400,751, discloses an integral compressor based on a linear cylinder configuration with part of the cylinders functioning as the driver engine and the other cylinders serving as the compressor function. The integral compressor design has several disadvantages. The major disadvantage is that both driver and compressor use a common crankshaft and share the same frame package. When failure occurs, of either the driver or compressor functions, the entire unit is rendered inoperable, requiring complete replacement or repair. The negative consequences of such a failure depend on where and how the compressor is installed. In addition, the operating envelope is more limited than that of a separable compressor in which the size and power of the driver engine is independent of the compressor. An integral compressor is constrained to only operate at the speed of the engine function since the functions share the same crankshaft. This design constraint severely limits the operating envelope of the integral design. In summary, the cited patents all relate to integral engine-compressor art. The present invention relates to a separable driver engine and compressor. Therefore, it appears that the above-mentioned patents are not directly relevant.

Virtually all relevant patent prior art seems to have been issued before 1940. Another U.S. patent, Stone U.S. Pat. No. RE 13,645, issued Nov. 11, 1913, discloses an air compressor comprised of apparatus including a main piston chamber, an annular chamber and a piston with two piston heads. The invention operates to draw in air, circulate it for cooling, and then force it out of an outlet valve. Stone's patent is directed to a different invention than that of the present invention. Another prior art patent, Tenney, U.S. Pat. No. 4,391,568, discloses a gas compressor using air cooling in an apparatus using fins to dissipate heat. Tenney's patent is directed to a different invention than that of the present invention.

Separable compressors are widely used to compress gases. Gas compressors have transported natural gas from the producing wells to consumers through high pressure pipelines for over 80 years. These compressors are needed because the outflow pressure of the vast majority of gas wells is lower than the pipeline pressure. Compressors are also used to equalize gas well pressures for a gathering system that combines multiple well outputs before injecting the gas into the transportation pipelines. Another important use for gas compressors is providing high pressure gas to lift oil from producing zones to the surface through special valves. In recent years multiple stage, high pressure compressors have been used to refuel vehicles that use compressed natural gas as a fuel. All gases including air are commonly compressed with separable compressors.

Ariel and Gemini are two of the largest manufacturers of separable compressor units. Gas compressor designs vary greatly. The most widely used design approach for small to medium size (50 to 5,000 horsepower) gas compressors employs one or more reciprocating pistons. The piston design is used because of the high efficiency and relative simplicity of sealing off the gas, thereby minimizing gas leakage. Numerous companies are producing this type of compressor. The March–April 1998 issue of CompressorTech provides numerous examples of current difficulties in the prior art. In one article, the need for many people trained in preventive maintenance is highlighted in order to achieve a high reliability of operation. The present invention, with its novel modular construction feature, simplifies preventive maintenance and overhauls. The modular construction technique that minimizes the number of compressor parts eases the maintenance burdens and reduces logistics problems. Knox Western, is another manufacturer of separable compressors, as described on page 22 of the March–April 1998 issue of CompressorTech. As is seen in the pictures, the models shown are huge and heavy relative to the Applicant's disclosed invention. The present invention overcomes this disadvantage by providing a relatively lightweight, compact compressor unit. Still another major design and maintenance problem of industrial compressors is highlighted on page 60 of the March–April 1998 issue of CompressorTech. Vibration problems are inherent in the current designs of compressors. Extensive monitoring programs exist, as described, to detect vibration as soon as possible, requiring the compressor to be shut down for maintenance. The present invention exhibits virtually no vibration because of its novel design in eliminating vibration through numerous damping and construction features.

The separable concept of a compressor disclosed herein uses a linear, or in-line, cylinder drive engine powering a separate compressor. Both the engine and compressor are configured from similar volume production piston engine components. There is an advantage to using the same engine for both the driver and the compressor function in order to maximize commonality of parts. The current technology demonstration unit uses a common block design. This preferred concept is useful over a wide range of potential applications. It is only where there is a substantial divergence of engine power envelope and compressor power requirements that a different configuration between the engine and compressor is necessary. The compressor is configured as an automotive engine converted to function as a gas compressor by removing the existing head and valve assembly, and adding only the necessary parts to insure efficient and reliable operation. This compressor unit is also capable of single or multiple stage operation. The separable package basically consists of an engine and a compressor which are joined by an endless belt, chain, or gears, plus structural parts to reduce the vibration to a minimum level as will be described below.

Many of the prior art separable gas compressors use horizontally opposed cylinder designs for the compressor and a relatively large and heavy driver engine. The engine and compressor are joined by a coupling. The disadvantages to this design approach are, first, that the package size of the two separable units is substantially greater than that of the integral compressor, and, second, that the maintenance of the separable units is more difficult because of different designs and parts used in the driver engine and compressor. The present invention overcomes the size and weight disadvantages through efficient packaging and low vibration levels and improves maintainability through maximum commonality of parts.

SUMMARY OF THE INVENTION

The above-mentioned difficulties and problems of the prior art are overcome by the present invention. Briefly stated, the present invention provides novel improvements to a separable engine-compressor combination. Although prior art includes separable engine-compressors, the present invention's novelty is in the modification approach in its design. Minimum modifications are designed in to achieve high performance at low manufacturing cost, as well as low field repair cost.

In summary, the present invention is comprised of high volume production parts, containing such parts as a crankshaft, pistons and connecting rods. One block is used for the driver engine which is appropriately modified to preferably operate using natural gas as a fuel. However, other combustible fuels (e.g. hydrogen) may also be used in the present invention. In addition, a liquid fuel may be used. The other block is modified to become a compressor, incorporating a crosshead piston feature. Attached to each crosshead piston is a piston rod that connects the crosshead piston to the upper compressor piston. The rod passes through a gas seal system that is contained within a seal housing. The upper piston reciprocates within the cylinder using conventional rings for sealing. At the top of the cylinder is the valve head that contains both the suction and discharge valves. Each cylinder of the compressor is sandwiched between upper and lower valve heads. The cylinder and heads are then secured to the block with bolts, also called studs.

This engine-compressor uses the advantages of common parts between the driver engine and compressor frame but keeps the units physically separate to make replacement of parts much easier, as well as easier repair of either module. Other additional novel features have been incorporated in this invention. One is the drive mechanism between the engine and the compressor. Instead of a direct drive, a belt drive used with pulleys is one of several embodiments. The diameters of the pulleys between the engine side and the compressor side are precalculated in order to optimize the performance matching of the engine assembly to the compressor assembly. For optimization, the ratio between the engine driver and the compressor is selectable, and is also calculated to meet each application requirement. This selectable speed ratio feature can also be accomplished through use of a chain or gears. The selectable speed ratio feature increases the useful operating range and reduces overall package size of the modular compressor. Another novel feature is the dampening (or suspension) system used for the coupled modular compressor. A dampening mechanism that dampens out vibration energy is used instead of the current art practice of increasing the mass of the compressor package to absorb the vibration energy that is so inherently destructive! This unique dampening system results in a smaller and lighter compressor package which will transmit lower levels of vibration to the base support structure without any performance penalties.

These, and other, features and advantages of the present invention are set forth more completely in the accompanying drawings and the following description.

BRIEF DESCRIPTION OF THE DRAWINGS

Details of the invention, and of the preferred embodiment thereof, will be further understood upon reference to the drawings, wherein closely related elements have the same number but different alphabetical suffixes, and further wherein.

DETAILED DESCRIPTION OF THE PREFERRED EMBODIMENT

Figure 1:
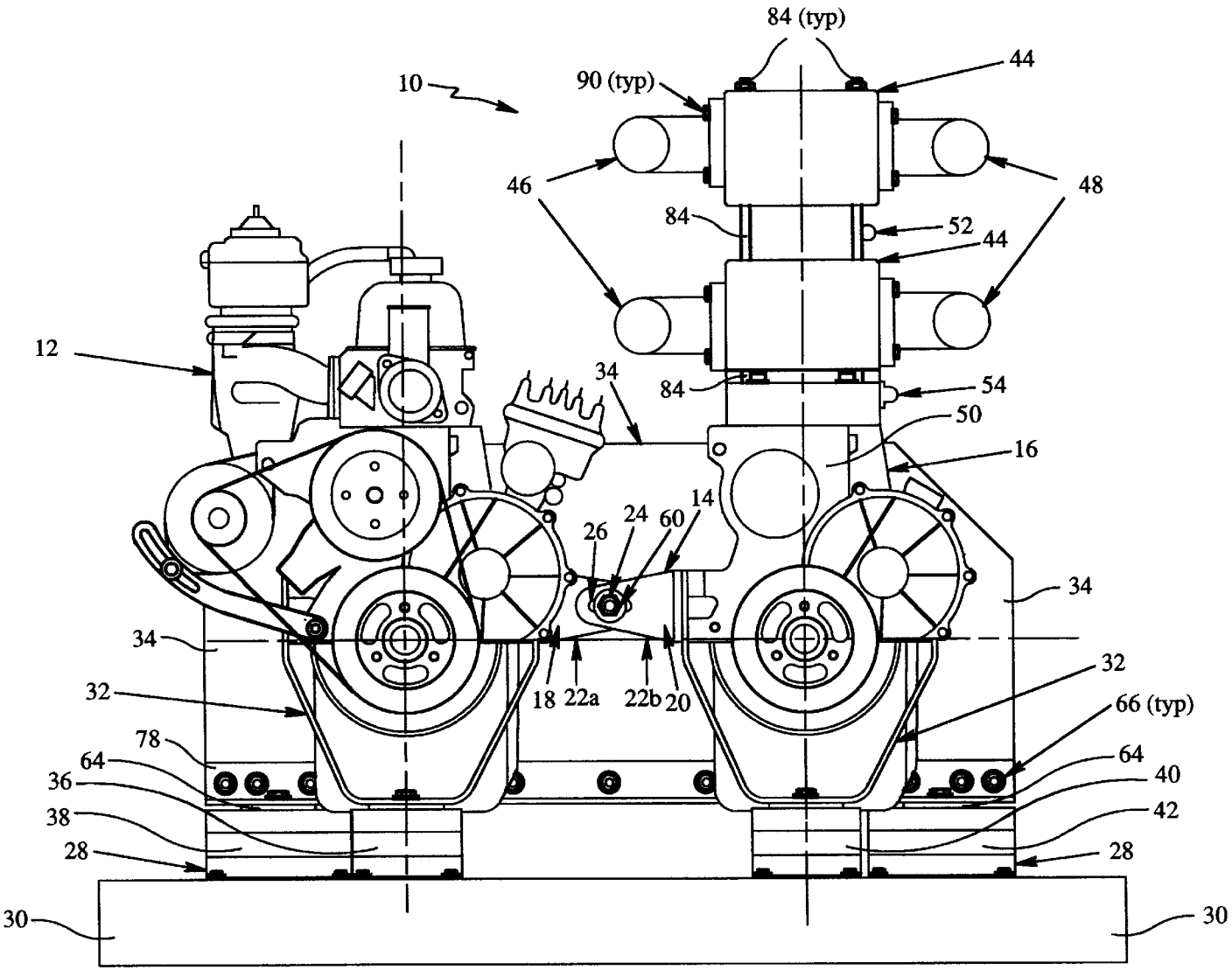
FIG. 1 is a front view of a schematic representation of the present invention illustrating the separable engine and compressor components, in addition to features of the dampening system.

Referring initially to FIG. 1, a front view of a schematic representation of the present invention is shown. Illustrated are a separable engine and compressor combination 10. Necessary input apparatus, such as a fuel tank with its accompanying piping and wiring, and the necessary output apparatus, such as gas gathering piping to a destination, are not shown because the present invention is directed towards novel improvements to the combination 10. Detailed descriptions of some well-known components in such a combination 10 are also not provided because they are known to those skilled in the art. To the left side of the combination 10, an engine assembly 12 is shown. Preferably, the engine assembly 12 is an in-line six cylinder engine. This type of engine is commonly used in such separable engine-compressor combinations. Also, preferably, the preferred configuration is a single stage unit. Other embodiments also are possible. The preferred configuration can be modified for either two stage operation or three stage operation with relative ease, as is known in the art. Compressor cylinder diameters would be reduced as required to provide higher compression ratios. Also, suction and discharge (input and output) manifolds would be modified. Interstage cooling apparatus would also be incorporated as needed. More specifically, for two stage operation, both the first and second stages would have three cylinders. For three stage operation, each of the stages, first, second, and third, would have two cylinders each.

Other engine models may be used interchangeably, such as an in-line four cylinder, V-6, V-8, V-12, or horizontally opposed cylinder engines, depending on the particular application and power requirements. The horsepower range for the present invention is dictated by the engine selected. The prototype model has a range of 10–80 horsepower. Conceivably, the present invention could accommodate engines providing one to several thousand horsepower. Similarly, the power rating for the present invention, that is the compression power, is dependent upon the flow rate and pressure ratio. It is noteworthy that virtually any gas can be used as a compression medium in the present invention. The only design consideration would be to select materials that would not be detrimentally affected by a particular gas. The engine assembly 12 is movably connected by a pivot mechanism 14 to a compressor assembly 16.

The pivot mechanism 14 comprises a first "U"-shaped brace 18, a second "U"-shaped brace 20, with the first brace 18 comprising two generally triangularly-shaped arms 22*a* of similar dimensions, and the second brace 20 comprising two generally triangularly-shaped arms 22*b* of similar dimensions, and a bolt and bushing assembly 24. The first brace 18 is fixedly connected to the engine assembly 12, while the second "U"-shaped brace 20 is fixedly connected to the gas compressor assembly 16. Both braces 18, 20 are pivotally connected to each other using the bolt and bushing assembly 24, with the triangularly-shaped arms 22*a* of the first brace 18 slidably fitting within the triangularly-shaped arms 22*b* of the second brace 20. Each of the triangularly-shaped arms 22*a*, 22*b* incorporates a horizontally-shaped slot 26, through which the bolt and bushing assembly 24 is slidably joined to each of the braces 18, 20. Note that in this FIG. 1, only two arms 22*a*, 22*b* are visible. The pivot 14 provides an independence between the engine assembly 12 and the gas compressor 16 so that dissipation of torsional forces occurs through a spring mount set 28. In other words, vertical and lateral movement of the engine/compressor combination 10 is provided by the spring mount set 28. The pivot 14 and the spring mount set 28 together constitute the optimal damping features of the engine generated vibrations, and provides for minimizing the size or footprint of the engine compressor combination 10. Therefore, torsional and linear vibration forces are effectively dissipated and effectively decouple the engine assembly 12, the compressor assembly 16 and a skid 30 from each other.

The compressor assembly 16 preferably has a basic component of an in-line six cylinder engine of identical model to the engine assembly 12. Both the engine assembly 12 and the compressor assembly 16 are fixedly mounted through a front mount 32 and a rear torque control plate 3 4, through the spring mount set 28, and ultimately to the skid 30. The front mount 32 is of single piece construction, and formed of a durable metal, such as steel. The front mount 32 is fixedly connected to the spring mount set 28 on its bottom end, and also fixedly mounted to the engine assembly 12 and the compressor assembly 16 proximate to the top end of the front mount 32. The rear torque control plate 34 is partially visible in FIG. 1. The engine assembly 12 and the compressor assembly 16 are separately and movably connected to the rear torque control plate 34.

The torque control plate 34 connects the engine assembly 12 and the compressor assembly 16 together and constrains relative lateral and rotational motion. Torsional and lateral vibration forces are dissipated through the bolt and bushing assembly 24 and the spring mount set 28, which is further comprised of four separate, yet similarly constructed, damping spring mounts 36, 38, 40, 42. More specifically, these spring mounts 36, 38, 40, 42 are first front spring mounts 36, first rear spring mounts 38, second front spring mounts 40, and second rear spring mounts 42. The manner of connection of the rear torque control plate 34 will be more fully described while discussing FIG. 2.

Each mount in the spring mount set 28 is preferably formed in a molding process using rubber as a material. Other suitably resilient material that dampens out vibration energy may be used. Not only is the spring mount set 28 designed to dampen any vibration energy, but is designed to avoid using a large structural mass to isolate the vibration energy from the skid 30. The engine assembly 12 is designed to move vertically and laterally on the first front spring mounts 36 and the first rear spring mounts 38. Similarly, the compressor assembly 16 may move vertically and laterally on the second front spring mounts 40 and the second rear spring mounts 42. Each of the four (4) separate mounts 36, 38, 40, 42 in the spring mount set 28 is designed to operate independently. The purpose of the mount set 28 is to optimally dampen any vertical, horizontal, or rotational vibration forces coming from the engine-compressor combination 10 during its operation.

The skid 30 is manufactured from a suitable metal, such as steel, to provide sufficient structural weight support to the engine assembly 12 and compressor assembly 16. In addition, the skid 30 needs to be manufactured to allow for lifting by crane or forklift, depending on the skid 30 weight and application. Because of the design of the mount set 28 and the engine-compressor combination 10, the skid 30 is no longer designed to be a heavy structural mass as now seen in the prior art. Avoiding a large structural mass has the major advantage of reducing costs through lower material costs,lower transportation cost, lower safety concerns due to strain on equipment and people, and increasing applications because of the smaller footprint of the skid 30. The present invention is intended to meet low to medium range compressor applications.

The compressor assembly 16 is differentiated from the engine assembly 12 primarily by removing an upper portion of the engine assembly 12 and adding components unique to compressor operation. As seen in FIG. 1, compressor head cylinder assemblies 44, compressor inlet manifolds 46 and compressor discharge (or outlet) manifolds 48 have been affixed atop a lower portion of a typical engine block 50. In addition, a cylinder oiler manifold 52 and a gas seal pack vent manifold 54 are shown. These additional components, unique to compressor construction of the present invention, will be more fully described in one or more of subsequent FIGS. 2–6. Importantly for cost considerations are the dimension requirements of the present invention. Dimensions of components are related to an application, that is, the capacity range of a particular model, and, therefore, part of the normal design process.

Figure 1A:
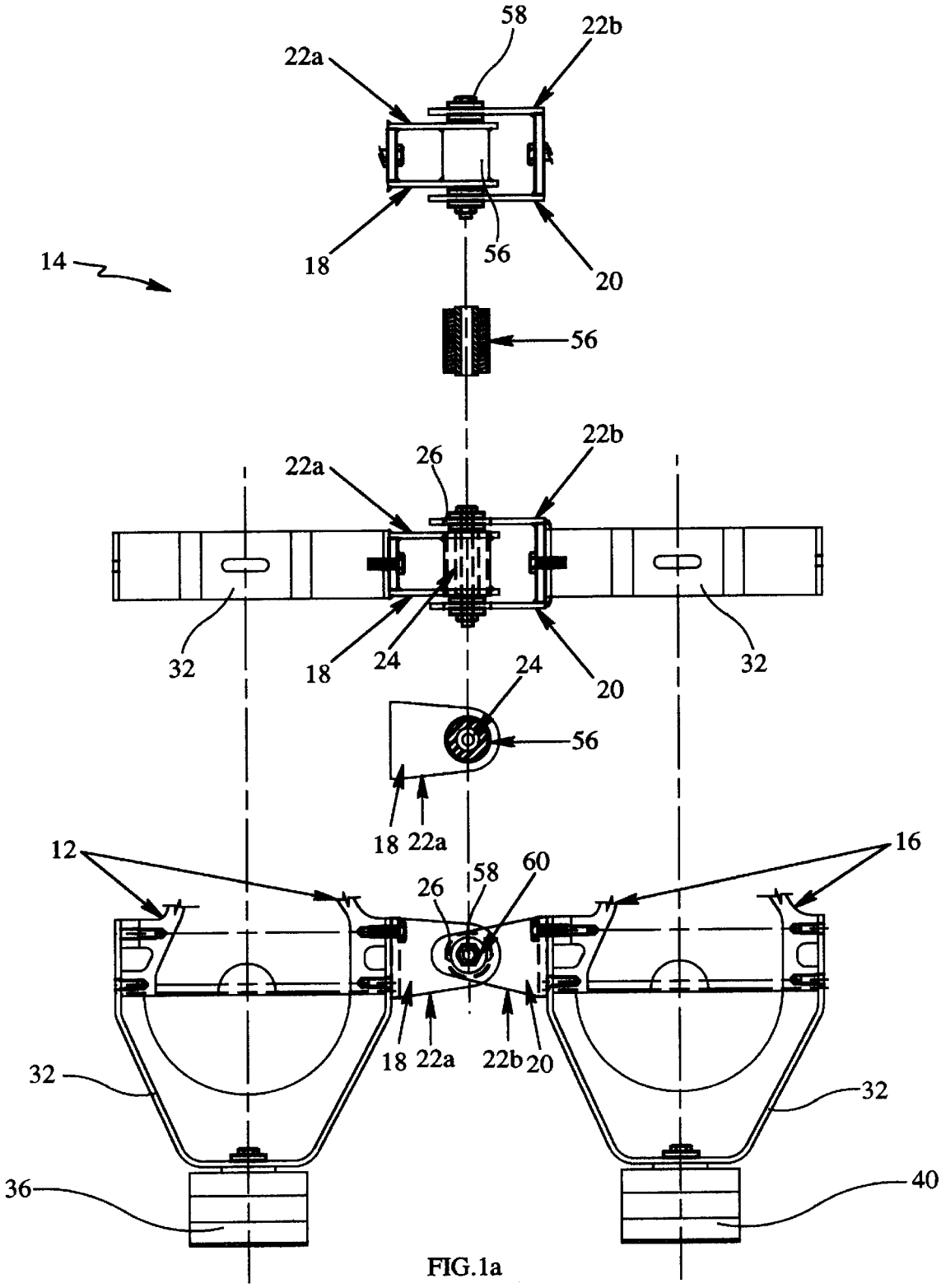
FIG. 1A shows both schematic plan and front views of a pivot mechanism illustrating the pivot connecting features, tubular bushing, and construction details.

Now referring to FIG. 1*a*, the bolt and bushing assembly 24 is more clearly seen as further comprising a tubular-shaped bushing 56, preferably manufactured from an elastomer material, thereby damping rotation and constraining lateral movement of the engine assembly 12 with respect to the gas compressor 16. The tubular-shaped bushing 56 functions as a concentric vibration isolation bushing, virtually preventing the engine assembly 12 from transmitting vibration to the compressor assembly 16. The bolt and bushing assembly 24 also comprises a bolt 58 axially positioned through the tubular bushing 56. The slot 26 allows for the initial alignment of the driver engine 12 and compressor 16 prior to securing of the bolt and bushing assembly 24 with a nut and a plurality of washers 60 to the bolt 58. The braces 18,20 are preferably manufactured from steel. Preferably made of steel,the pivot 14 may also be made of aluminum or composite materials. The pivot 14 is a key novel feature of the present invention. The pivot 14 allows rotational movement between the engine assembly 12 and the compressor assembly 16 during operation.

Figure 2:
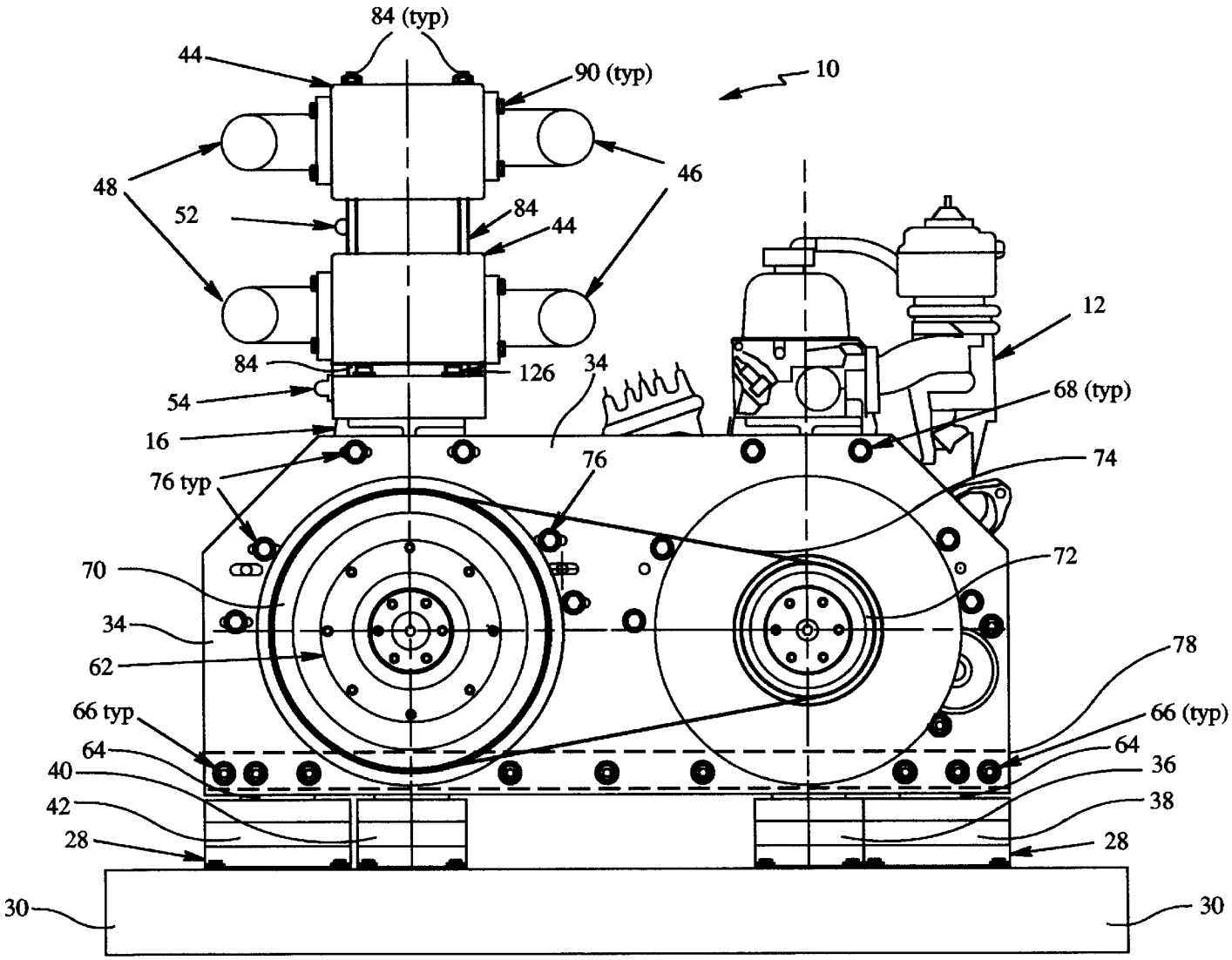
FIG. 2 is a rear view of a schematic representation of the present invention illustrating additional features of the suspension system and their interface with other components in addition to the power driver-to-compressor drive system with the selectable speed ratio feature.

Referring now to FIG. 2, a rear view of a schematic representation of the present invention is shown. Specifically, additional features of the suspension system are more clearly seen. Plus, an engine-compressor drive system 62 with the selectable speed ratio feature is illustrated.

Fixed to the skid 30 are seen the first rear spring mount 38 and the second rear spring mount 42. The rear torque control plate 34 will now be more fully described as stated while describing FIG. 1. A torque control plate connector assembly 64 is fixedly connected to the first and second rear spring mounts 38, 42. The means for connection is by use of a typical "L" shaped angle bracket 78 (shown here in hidden lines and more clearly shown in FIG. 3) made of standard materials. This "L" shaped bracket 78 is part of the connector assembly 64.(Note that the bracket 78 is shown in FIG. 1, yet described in FIGS. 2 and 3). However, the materials have been chosen for appropriate strength to isolate vertical vibration loads from the engine-compressor combination 10 through the first and second rear spring mounts 38, 42 to the skid 30. Now the rear torque control plate 34 is fixedly connected to the "L" shaped bracket 78 through a first plurality of bolt and nut devices 66. The rear torque control plate 34 is a major part of the novel feature of the present invention. The control plate 34 not only solidly secures the engine-compressor combination 10 to the skid 30, but disperses vibration stresses from the combination 10 while also isolating the remaining vibration loads from the skid 30.

As stated in previously describing FIG. 1, the plate 34 connects the engine assembly 12 and the compressor assembly 16 together and constrains relative lateral and rotational motion. Torsional and lateral vibration forces are constrained and dissipated through the bolt and bushing 24 and the spring mounts 36, 38, 40, 42. Operation tests have allowed a person to place their hand on the torque plate or the engine-compressor combination 10 without feeling virtually any vibration! This dampening of vibration to a minimal level is a major advantage in the art. In addition, this dampening result is unexpected in a field long accustomed to vibration as a major problem to overcome. The torque control plate 34 is preferably made of steel. However, the torque control plate 34 may also be made of aluminum or composite materials. The specific dimensions of the control plate 34 are somewhat dependent on the power requirements and application of the engine-compressor combination 10. Also, the torque control plate 34 is fixedly connected to the engine-compressor combination 10 through a second plurality of bolt and nut devices 68.

Now, the engine-compressor drive system 62 with the selectable ratio feature will be described as shown in FIG. 2. The drive system 62 is connected to the engine-compressor combination 10 through both the engine assembly 12 and the compressor assembly 16. More specifically, and preferably, the drive system 62 is comprised of a compressor pulley 70, an engine pulley 72 and a drive belt 74. The pulleys 70, 72 are attached to flywheels which are standard for these types of engines. In a second embodiment (not shown), the drive system 62 is comprised of a compressor sprocket, an engine sprocket, a drive chain, and flywheels. A third embodiment (not shown) of the drive system 62 is comprised of a compressor gear, an engine gear, an idler gear drive, and flywheels.

Prior art includes drive systems with one to one engine to compressor ratios, thereby limiting applications. More specifically, one to one drive ratio prior art does not optimize and match the driver engine characteristics to the compressor assembly output parameters. A torque curve is created comparing revolutions per minute (rpm) versus horsepower uniquely for each engine type. An optimum rpm exists for long life and required horsepower. However, the torque curve does not necessarily match the compressor speed required to deliver the flow volume and pressure for each type of gas. In the current art, a packager of engines will select a certain existing engine to best match compressor requirements. Normally, the drive ratio between the engine and compressor is one. Therefore, if the compressor speed requirement is not equal to the optimum speed of the engine then the engine will not operate efficiently.

In the present invention, several advantages exist over the prior art. One is that the drive belt is unique to this application. The arrangement of the drive system 62 parts is unique. Still another advantage is that the driver engine assembly 12 rpm characteristics are set to maximize the compressor power output parameters, based on the desired gas flow volume. The present invention can use a two to one ratio, yet this is just one selectable ratio option of the drive system 62 that optimizes a particular combination 10 with its unique operating characteristics. Still another advantage to the present invention is the ability to change the driver-compressor speed ratio in the field by changing the compressor pulley 70 or drive belt 74, thereby optimizing the compressor assembly output parameters. As previously discussed while describing FIG. 1, the engine assembly 12 and the compressor assembly 16 are separately and movably connected to the rear torque control plate 34. This connecting feature allows for proper tensioning of the compressor pulley 70 or drive belt 74 and setting proper clearances for the control plate 34 through a plurality of bolt and nut assemblies 76. The plurality of bolt and nut assemblies 76 also assists in fixedly connecting the torque is control plate 34 to the engine-compressor combination 10.

Figure 3:
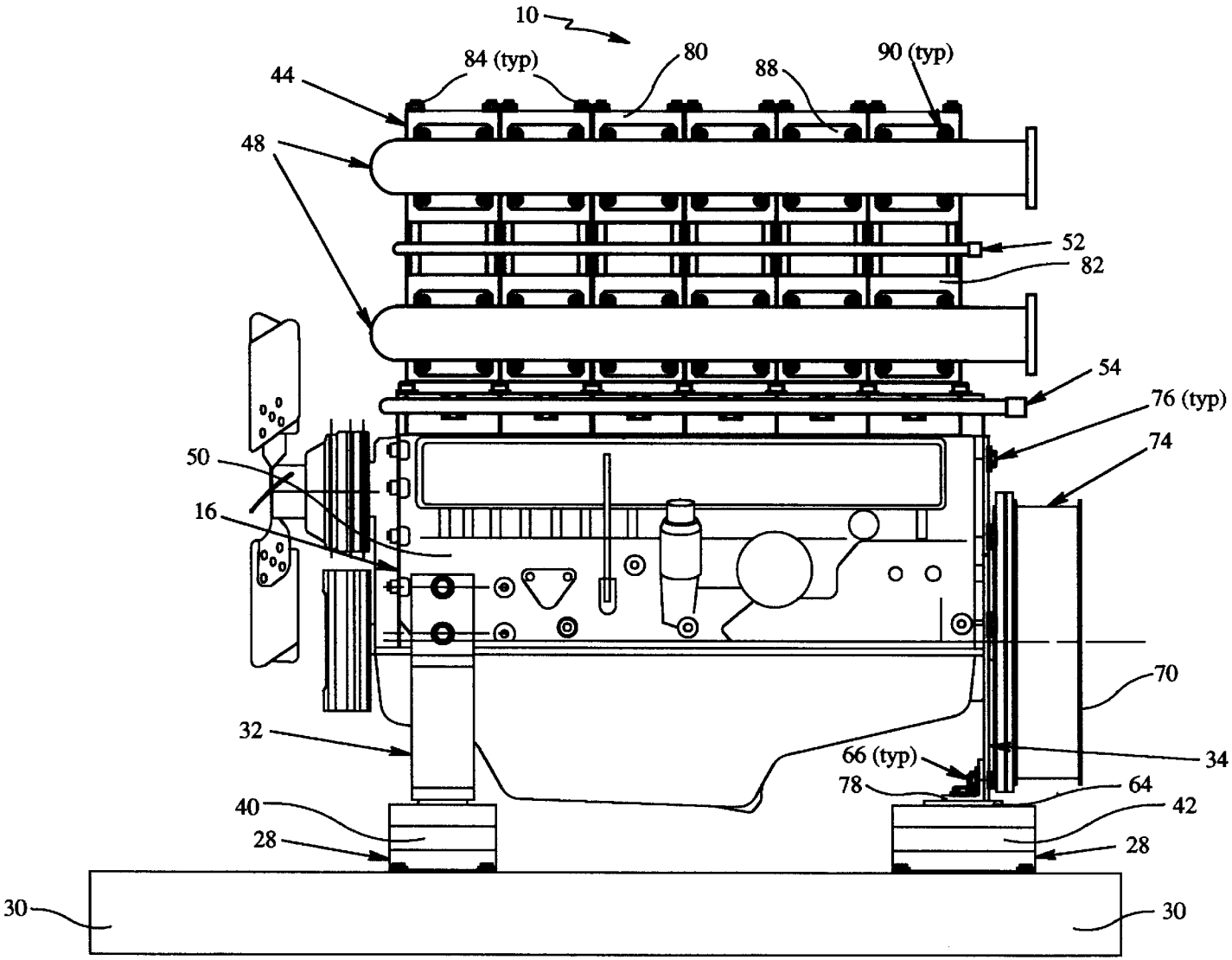
FIG. 3 is the right side elevation view schematic representation of the present invention illustrating modular construction features.

Next referring to FIG. 3, the side elevation view of the compressor illustrates, clearly for the first time, the novel modular construction feature. In addition, the means of connection between the engine-compressor combination 10 and the skid 30 is again shown, though previously described in the description of FIGS. 1 and 2. The Applicant will first amplify on the connection means. As previously described in discussing FIG. 1, the front mount 32 is of single piece construction, and is fixedly connected to the spring mount set 28 on its bottom end, and also fixedly mounted to the engine assembly 12 and the compressor assembly 16 proximate to the top end of the front mount 32. The front mount 32 of this connection means is shown clearly fixedly attached to the compressor assembly 16. The front mount 32 will also be shown similarly attached to the engine assembly 12 in discussing FIG. 4.

As previously briefly described in FIG. 2, the torque control plate connector assembly 64 is fixedly connected to the first and second rear spring mounts 38, 42. The means for connection is the "L" shaped angle bracket 78 shown clearly in FIG. 3. The "L" shaped angle bracket 78 extends across the full width of the bottom rear of the engine-compressor combination 10 and is connected to the combination 10 with the first plurality of bolt and nut devices 66. This bracket 78 helps to stiffen the torque plate 34.

The modular construction feature is a novel means of designing each of the compressor head cylinder assemblies 44. The major advantages to this feature are minimizing thermal stresses. As is well known in the art, thermal stresses in compressor cylinder heads result from high differential temperatures within the compressor assembly 16, as well as in the environment where the engine-compressor combination 10 is located. Shown in FIG. 3, are a plurality of the compressor head cylinder assemblies 44 connected to the engine block 50 of the compressor assembly 16. More specifically, these compressor cylinder head assemblies 44 are configured in-line in two banks, one atop the other, which in turn are connected to the engine block 50. In the present invention, double acting operation is the preferred embodiment. Therefore, FIG. 3 shows one of the compressor discharge manifolds 48 with a first bank of compressor head cylinder assemblies 80 proximate to and connected to a second bank of compressor cylinder head assemblies 82. The unique modular construction involves manufacturing each of the compressor cylinder head assemblies 44 separately. Then, a plurality of cylinder head assemblies 44 are secured together in two banks, one atop the other.

The means of securing the separate cylinder head assemblies 44 together is by using long bolts 84 threaded at both ends and fabricated from high strength steel or other suitably strong material as known in the art. Therefore, during operation, each of the individual compressor cylinder head assemblies 44 is able to thermally expand and contact without transmitting these forces to adjacent cylinders. This construction feature provides a simple long sought after solution to the major problems of thermal stress forces so potentially destructive to equipment.

This modular design also allows manufacturing of many smaller identical parts rather than large singular parts. Therefore, advantages include lower costs because of easier manufacture and high volume production. Another advantage includes easier maintenance and repair because of the smaller simpler parts. In addition, this modular construction feature minimizes thermal stresses in the compressor by isolating each cylinder to expand and contract without transmitting stress to the adjacent cylinders, thereby providing another solution to a long endured problem.

In addition, design costs, material costs, repair costs, and insurance costs all go down as a result of the novel vibration dampening. The entire footprint of the engine-compressor combination 10, which includes the skid, is smaller and weighs virtually an order of magnitude less relative to prior art delivering similar power requirements. The result of these novel improvements also means that less-developed countries can afford the equipment to further improve their economies.

Figure 4:
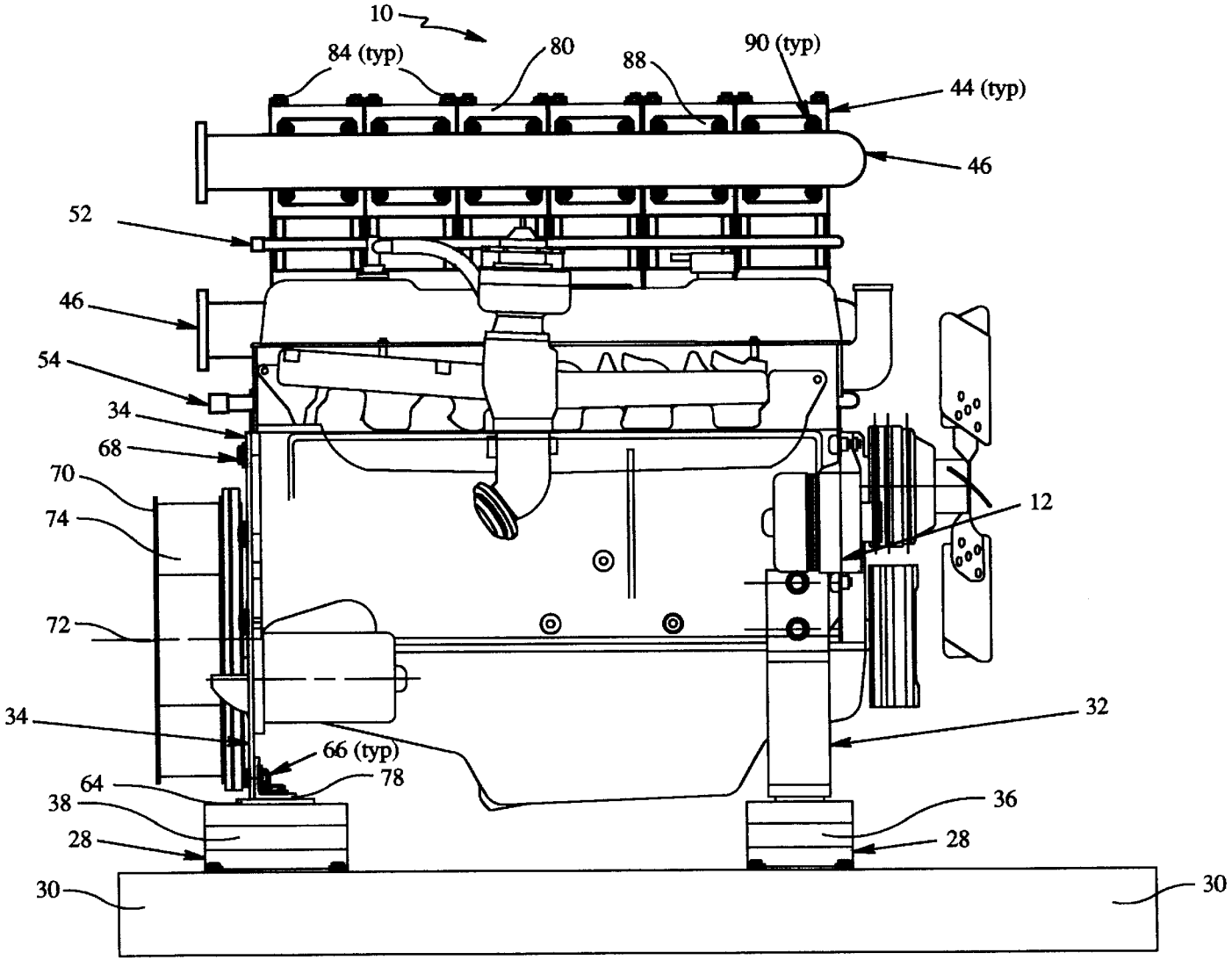
FIG. 4 is the left side elevation view schematic representation of the present invention illustrating modular construction features.

Referring to FIG. 4, the side elevation view also illustrates modular construction features. In addition, the means of connection between the engine-compressor combination 10 and the skid 30 is again shown. The Applicant will first amplify on the connection means. As mentioned while describing FIG. 3, the first spring front mount 36 is shown, in FIG. 4, to be fixedly attached to the engine assembly 12. As also previously briefly described in FIG. 3, the torque plate connector assembly 64 is fixedly connected to the first front and first rear spring mounts 36, 38. Shown in FIG. 4 is the first rear spring mount 38. The means for connection is the "L" shaped angle bracket 78 again shown clearly.

Again in FIG. 4, as previously shown and described for FIG. 3, a plurality of the compressor cylinder head assemblies 44 are shown. More specifically, FIG. 4 clearly shows one of the banks of these compressor cylinder head assemblies 44. The other bank is obscured because it is behind the engine assembly 12. Now the compressor inlet manifolds 46 are clearly shown in this FIG. 4.

Figure 5:
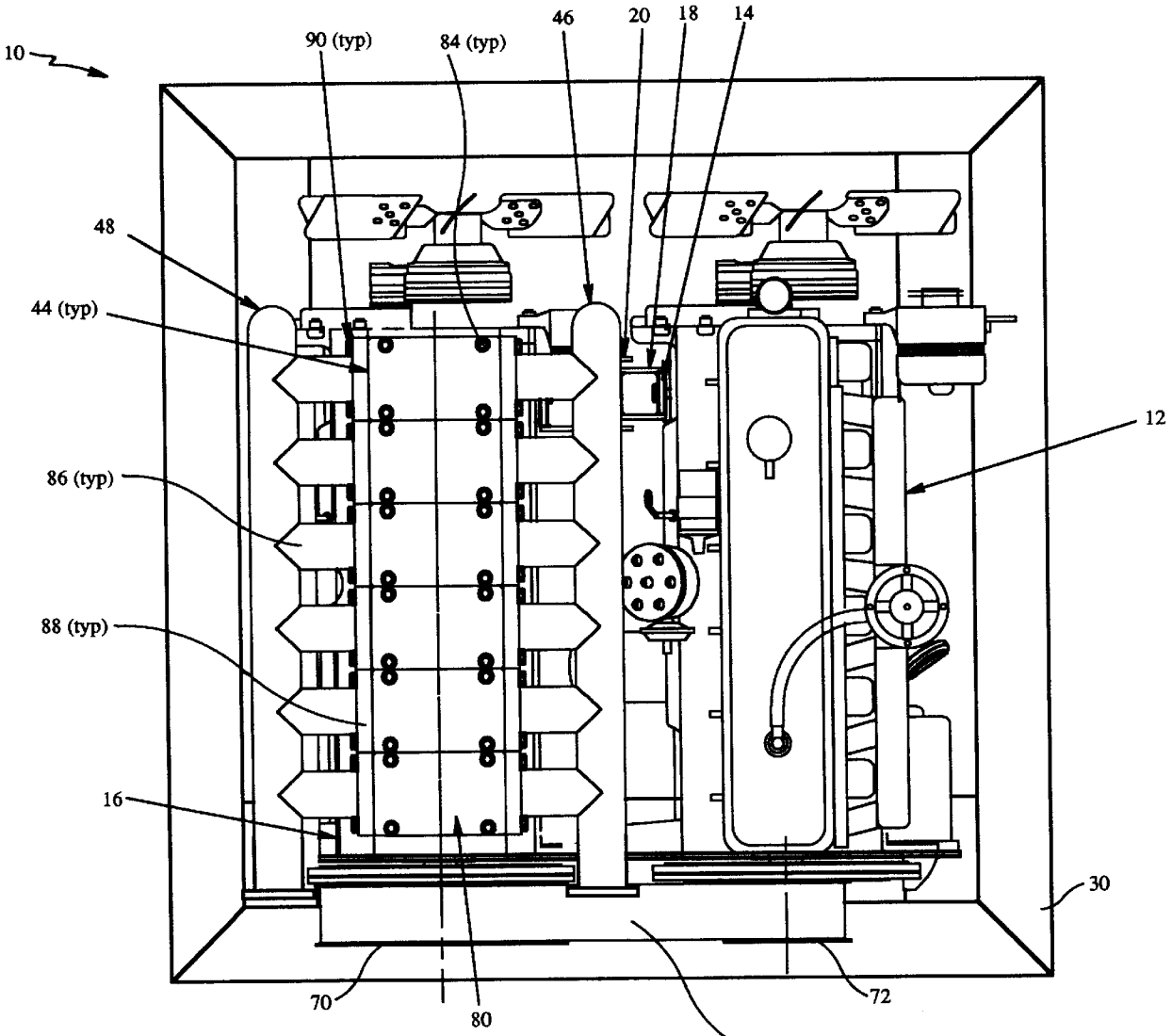
FIG. 5 is a plan view schematic representation of the present invention illustrating its modular construction and thermal stress reduction feature of the present invention and its interface with other components.

Now referring to FIG. 5, a plan view of the present invention illustrates its modular construction and thermal stress reduction feature. More clearly seen in FIG. 5 are the plurality of compressor cylinder head assemblies 44. Each of such cylinder head assemblies 44 is in-line with an adjacent one. There is space between each of the modular compressor cylinder head assemblies 44. This separation isolation allows for thermal expansion/contraction and vibration isolation between the assemblies 44. The space also eases the replacement of a single or multiple cylinder head assemblies. Another construction feature now seen in FIG. 5 is a series of manifold elbows 86 which are integrally welded to connect from each pair of cylinder head assemblies 44 through cylinder head mounting flanges 88 to their respective compressor inlet manifold 46 and compressor discharge manifold 48. This construction feature is known in the art and requires no additional description. Both the compressor inlet manifold 46 and the discharge manifold 48 are designed to minimize thermal stresses from transmitting force to the adjacent cylinders. The design minimizes these stresses by allowing the manifold elbows 86 to flex. In addition, the inlet and discharge manifolds 46, 48 are welded to their respective cylinder head assemblies 44 through cylinder head mounting flanges 88 which bolt to their respective cylinder head assemblies 44. Also, manifold retaining fasteners 90 are used to attach the inlet and discharge manifolds 46, 48 to the cylinder head assemblies 44.

In addition to the above description, note that another view of the pivot 14 is provided. In this plan view is seen more clearly that there are the first "U"-shaped brace 18, and a second "U"-shaped brace 20, spaced proximate to each other. The two braces 18, 20 are joined with the previously mentioned bolt and bushing assembly 24 (not seen in this FIG. 5).

Figure 6:
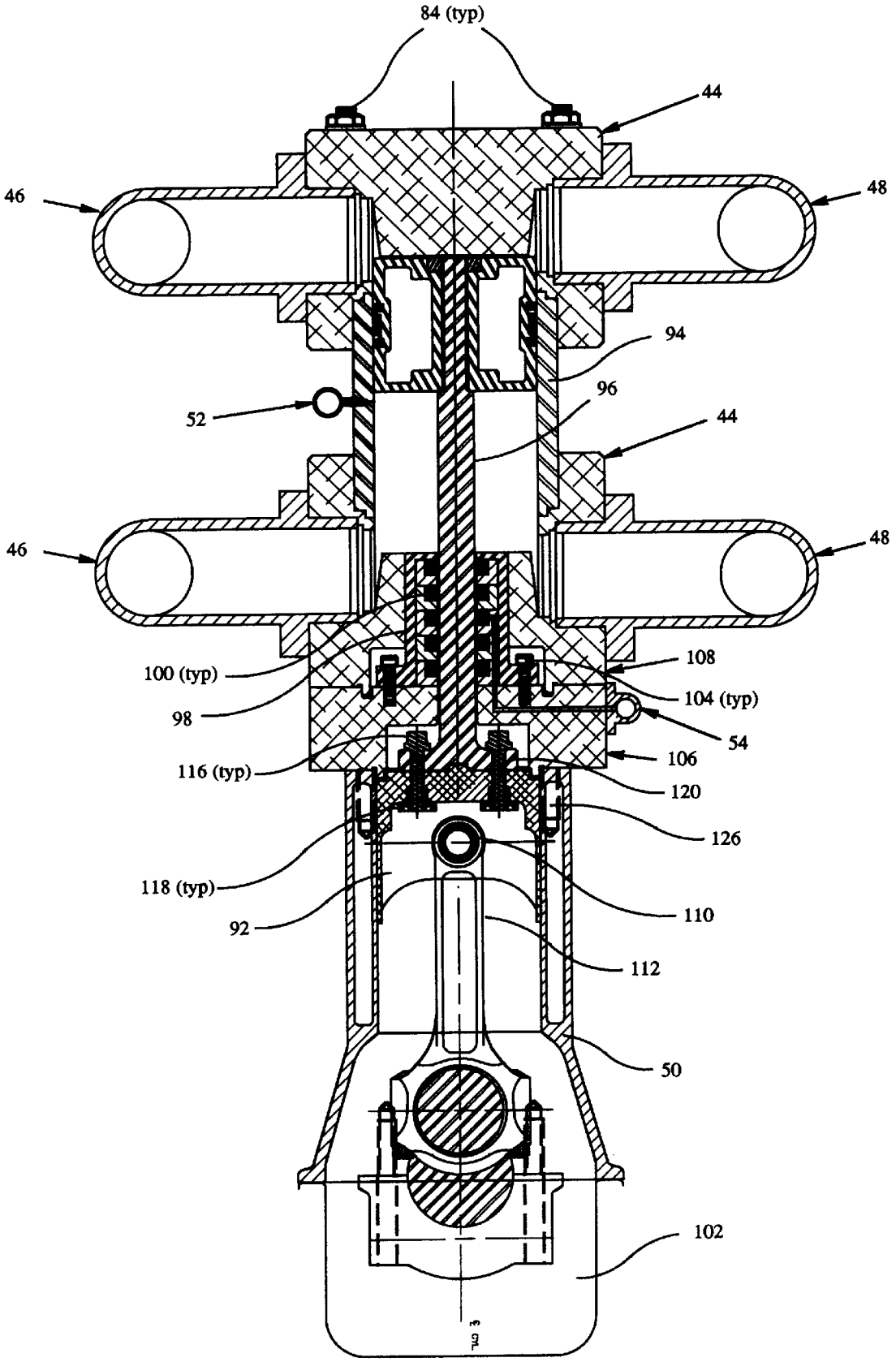
FIG. 6 is a vertical section view of a typical cylinder assembly showing various components illustrating novel features of the present invention.

Finally, referring to FIG. 6, a vertical section view of the typical compressor head cylinder assembly 44 shows a crosshead piston 92 (usually termed a crosshead), and a double acting cylinder 94 is secured with the plurality of long bolts 84 first mentioned in the description of FIG. 3. The double acting cylinder 94 and the use of uniquely designed long bolts 84 are novel features that will be described shortly. These features are additional stress reduction means of the present invention. The crosshead piston 92 is used with a piston rod 96 in each cylinder 94. Each of a plurality of gas seal pack assemblies 98 incorporate a plurality of gas seals 100. The plurality of gas seals 100 on each piston rod 96 eliminate gas leakage into each compressor crank case 102. Any leakage gas through the gas seals 100 is collected and channeled to the gas seal pack vent manifold 54. The gas seal pack assemblies 98 (which include vent, purge and oiling connections) are also novel compared to the prior art. A plurality of gas seal retaining bolts 104 affix each of the gas seal pack assemblies 98 to each lower seal housing adapter block 106. These gas seal pack assemblies 98 eliminate all the typical copper tubing lines used to lubricate, vent and purge the gas seals 100. Since no tubing is required, no large seal access chamber is needed to house one of the gas seal pack assemblies 98 as in the prior art. Therefore, lighter weight upper and lower seal housing adapter blocks 108, 106 are possible. Because of the smaller adapter blocks 108, 106, a shorter piston rod 96 is needed. No need exists in the present invention for an access plate to allow for assembly of the gas seal pack assemblies 98.

The gas seals 100 permit use of gas purging to isolate fugitive emissions or volatile organic compounds (VOCs) or other gases, such as hydrogen, from leaking to the compressor crankcase 102 or to the atmosphere. The use of the gas seals 100 effectively prevents gas from entering the crankcase 102 during operation of the compressor 16 and contaminating the lubrication oil in the crankcase 102. A wrist pin 110, within the crosshead 92, allows for a pivoting motion between a crosshead connecting rod 112 and the crosshead piston 92. This particular novel design can accommodate single or double acting cylinders is known in the art.

The design of the crosshead 92 incorporates a unique attachment mechanism. Specifically, the attachment mechanism comprises two or more crosshead bolts 116 is a load spreading crosshead "T" nut 118. The attachment mechanism feature overcomes a long standing design problem with crossheads. The very nature of the reciprocating action, and the intertial force generated, has previously required a high strength material to support the singular threaded interface between the crosshead 92 and the piston rod 96. The novel attachment mechanism dissipates the reciprocating force through the two long crosshead bolts 116, thereby permitting aluminum to be used in the crosshead 92. Specifically, the long crosshead bolts 116 are fastened into a piston rod flange 120.

This novel feature is that each crosshead bolt 116 is secured within the crosshead 92 with the uniquely shaped load spreading crosshead nut 118. The approximate oval shape of the crosshead nut 118 (as viewed from the top) provides for greater stress load distribution in the crosshead 92. Since the nut 118 is three dimensional, one can also describe it as generally egg-shaped or ellipsoid. The ellipsoid shape restricts the nut from rotating and is a more contiguous fit to the shape of the underside of the crosshead 92. When viewed from the side, the crosshead nut 118 is "T" shaped.

Nonetheless, because of the unique crosshead nut 118, stress load is spread over a larger area and permits the use of aluminum for the crosshead. The use of aluminum allows lighter weight, reduced friction and lower cost components.

In the current art, the connecting fasteners between the cylinder heads, seal housing, and the crankcase are internal to the cylinder assembly, seal housing, and crank case. This design in the current art results in wasted space between the cylinder heads and the crankcase. In addition, the stress created because of the connecting means and movement of the pistons requires that the entire structure: cylinder heads, connecting fasteners, and spacer structure between the cylinder heads and the crankcase must be heavy to withstand the forces generated. In the novel construction feature in the present invention, the long bolts 84 are outside the cylinder structure and, therefore, do not transmit stress loads that distort the cylinder bores. Therefore, less stresses are developed and transmitted throughout the structure. Another way of understanding the novelty of the long bolts 84 is to envision each of the double acting cylinders 94 as floating free. Therefore, the bores of the double acting cylinders 94 only need to handle hoop strength loads. The long bolts 84 actually stretch as they absorb thermal and mechanical stress forces. The upward force exerted on the upper head assembly by the piston compressing the gas stretches the bolts 84 which then reduces the compressive force on each of the double acting cylinders 94. Therefore, constant and uniform compression loads exist through the cylinder assemblies 94, preventing distortion, heat transmission and thermal stress.

Continuing with FIG. 6, each of the lower seal housing adapter blocks 106 is connected between each upper gas seal housing adapter block 108 to the crankcase 50 by a plurality of seal housing adapter bolts 126.

Numerous test operations of the present invention have proven the operability of each of the aforementioned novel features. Although an in-line six cylinder engine was used as the basic structure of the separable engine and compressor combination 10 for the demonstration model, other engines may be substituted including in-line, horizontally opposed and "V" configuration engines, from a variety of manufacturers world-wide. The choice of engines is dependent on specific operating requirements or availability of engines. The present invention improves or provides the solutions to the many problems associated previously with separable engine-compressor combinations. Just a few of those solutions described herein include minimizing vibration effects through optimal dampening, minimizing of the detrimental effects of thermal stresses through modular construction, reducing costs by eliminating heavy materials and unnecessary cooling apparatus, plus minimizing costly maintenance and repair through optimal design. Additionally, another solution provided is in the drive system 62 design providing an optimized engine-compressor ratio feature.

Consequently, while the foregoing description has described the principle and operation of the present invention in accordance with the provisions of the patent statutes, it should be understood that the invention may be practiced otherwise as illustrated and described above and that various changes in the size, shape, and materials, as well as on the details of the illustrated construction may be made, within the scope of the appended claims without departing from the spirit and scope of the invention.

What is claimed is:

1. A separable internal combustion engine and gas compressor apparatus comprising:

a driver;

a gas compressor;

a skid;

separable means for physically connecting said driver and said gas compressor, wherein said separable means includes a pivot mechanism;

connecting means for physically connecting said driver and said gas compressor to said skid;

dampening means for vibration dampening said driver and said gas compressor from said skid; and driving means for driving said gas compressor with said driver.

2. The apparatus according to claim 1, wherein said separable means further includes:

a rear torque control plate; for physically connecting said driver engine and said gas compressor, and wherein said pivot mechanism and said rear torque control plate are fixedly connected between said driver engine and said gas compressor, and further wherein said pivot mechanism further comprises:

a first "U"-shaped brace, comprising two generally triangularly-shaped arms of similar dimensions;

a second "U"-shaped brace, comprising two generally triangularly-shaped arms of similar dimensions; and a bolt and bushing assembly; wherein said first "U"-shaped brace is fixedly connected to said engine assembly, and wherein said second "U"-shaped brace is fixedly connected to said compressor assembly, and further wherein said first and second "U"-shaped braces are pivotally connected to each other using said bolt and bushing assembly, with said triangularly-shaped arms of said first brace slidably fitting within said triangularly-shaped arms of said second brace, and further wherein each of said triangularly-shaped arms incorporates a horizontally-shaped slot, through which said bolt and bushing assembly is slidably joined to each of said braces, and wherein said nut and bushing assembly further includes a tubular-shaped bushing, preferably manufactured from rubber, thereby damping rotation and constraining lateral movement of said engine assembly with respect to said compressor, and further wherein said bolt and bushing assembly comprises a bolt axially positioned through said tubular bushing, and wherein said slot allows for the initial alignment of the driver engine and compressor prior to securing of said bolt and bushing assembly with a nut and a plurality of washers to said bolt, and further wherein said braces are preferably manufactured from steel, and further wherein said rear torque control plate is preferably manufactured from steel.

3. The apparatus according to claim 1, wherein said drive system is further comprised of a compressor pulley, an engine pulley, a drive belt, and flywheels.

4. The apparatus according to claim 1, wherein said drive system is further comprised of a compressor sprocket, an engine sprocket, a drive chain, and flywheels.

5. The apparatus according to claim 1, wherein said drive system is further comprised of a compressor gear, an engine gear, an idler gear drive, and flywheels.

6. The apparatus according to claim 1, wherein said drive system has a selectable speed ratio option, thereby optimizing a particular combustion engine and gas compressor.

7. The apparatus of claim 1, wherein said dampening means further comprises:

a rear torque control plate;

four damping spring mounts; and a plurality of torque plate connector assemblies, each of said torque plate assemblies further comprising a plurality of nuts and bolts and an "L" shaped angle bracket, wherein said plurality of nuts and bolts fixedly connect said "L" shaped bracket to said rear torque control plate and to each of said damping spring mounts, and further wherein a first front spring mount and a first rear spring mount of said damped spring mounts fixedly connect said driver engine torque plate to said skid, and a second front spring mount and a second rear spring mount of said damping spring mounts fixedly connect said gas compressor torque plate to said skid, and further wherein said plurality of nuts and bolts fixedly connect said spring mounts to said skid, said driver engine, said gas compressor and to both of said torque plates, whereby said damping spring mounts permit vertical and lateral movement of said driver engine and said gas compressor, thereby effectively dissipating torsional and linear vibration forces.

8. The apparatus according to claim 1, wherein said internal combustion engine is a motor.

9. The apparatus according to claim 2, wherein said pivot mechanism is manufactured from aluminum.

10. The apparatus according to claim 2, wherein said pivot mechanism is manufactured from composite materials.

11. The apparatus according to claim 2, wherein said rear torque control plate is manufactured from aluminum.

12. The apparatus according to claim 2, wherein said rear torque control plate is manufactured from composite materials.

13. The apparatus according to claim 1 wherein said gas compressor is further comprised of an internal combustion cylinder block;

a plurality of compressor head cylinder assemblies;

a plurality of compressor inlet manifolds;

a plurality of compressor outlet manifolds;

a plurality of manifold elbows;

a plurality of cylinder flanges; and means for fixedly connecting said plurality of assemblies, manifolds, elbows, and flanges together, wherein each of said manifolds is integrally welded to one of said manifold elbows, and wherein each of said elbows is then integrally welded to one of said cylinder flanges, and further wherein each of said cylinder flanges is then bolted to one of said compressor head cylinder assemblies.

14. The apparatus according to claim 13, wherein said plurality of compressor head cylinder assemblies are configured in a first and a second in-line bank, each of said banks fixedly secured to the other, one atop the other, and wherein said banks are further comprised of multiple cylinder assemblies in a modular construction manner, thereby providing a means for minimizing thermal stresses by allowing each cylinder assembly to expand and contract without applying any force to the cylinder assembly next to it.

15. The apparatus according to claim 14, wherein said cylinders are fixedly secured to said seal assembly using a plurality of long bolts, thereby providing the means for securing the cylinder assemblies to the block without requiring the cylinders to carry any tension loads, thereby relieving the distortion to the cylinder bores without requiring great mass and size.

16. The apparatus according to claim 15, wherein said long bolts are fabricated from high strength steel.

17. The apparatus according to claim 1, wherein said gas compressor further comprises a plurality of lower gas seal housing adapter blocks, each of said blocks connected between an upper gas seal housing adapter block and a crankcase with a plurality of seal housing adapter bolts.

18. The apparatus according to claim 17 wherein said gas compressor further comprises a crosshead within a double acting cylinder, said crosshead secured with a plurality of crosshead bolts, said crosshead bolts secured within said crosshead with a generally ellipsoid shaped load spreading crosshead nut, thereby providing reduced stress on said crosshead.

19. The apparatus according to claim 17, wherein said gas compressor is comprised of six in-line cylinders, thereby providing single stage operation.

20. A separable internal combustion engine and gas compressor apparatus comprising:

a driver engine;

a gas compressor;

a pivot mechanism;

a rear torque control plate; for physically connecting said driver engine and said gas compressor;

a front mount;

four spring mounts;

a drive system for said driver engine to drive said gas compressor; and a skid, wherein said driver engine and said gas compressor each further comprise reciprocating blocks, and wherein said each of said spring mounts flexibly connects said driver engine and said gas compressor to said skid, and further wherein said driver engine and said gas compressor are fixedly mounted through said front mount and said rear torque control plate through said spring mount set and ultimately to said skid, and further wherein said front mount is of single piece construction, and preferably formed of steel, and further wherein said front mount is fixedly connected to said spring mount set on its bottom end, and also fixedly mounted to said driver engine and said gas compressor proximate to a top end of said front mount.

21. The apparatus according to claim 20, wherein said drive system is further comprised of a compressor pulley, an engine pulley, a belt drive, and flywheels.

22. The apparatus according to claim 20, wherein said drive system is further comprised of a compressor sprocket, an engine sprocket, a drive chain, and flywheels.

23. The apparatus according to claim 20, wherein said drive system is further comprised of a compressor gear, an engine gear, an idler gear drive, and flywheels.

24. The apparatus according to claim 20, wherein said drive system has a selectable ratio option, thereby optimizing a particular combustion engine and gas compressor.

25. The apparatus of claim 20, wherein said rear torque control plate further comprises a plurality of torque control plate connector assemblies, each of said torque plate assemblies further comprising a plurality of nuts and bolts and an "L" shaped angle bracket, wherein said plurality of nuts and bolts fixedly connect said "L" shaped angle bracket to said rear torque control plate and to each of said damping spring mounts, and further wherein a first front spring mount and a first rear spring mount of said damping spring mounts fixedly connect said driver engine to said skid, and a second front spring mount and a second rear spring mount of said damping spring mounts fixedly connect said gas compressor to said skid, and further wherein said plurality of nuts and bolts fixedly connect said spring mounts to said skid and said driver engine and said gas compressor, whereby said damping spring mounts permit vertical and lateral movement of said driver engine and said gas compressor, thereby effectively dissipating torsional and linear vibration forces.

26. The apparatus according to claim 20, wherein said internal combustion engine is a motor.

27. The apparatus according to claim 20, wherein the fuel for said apparatus is natural gas.

28. The apparatus according to claim 20, wherein the fuel for said apparatus is hydrogen.

29. The apparatus according to claim 20, wherein said driver engine is an in-line six cylinder engine.

30. The apparatus according to claim 20, wherein said driver engine is an in-line four cylinder engine.

31. The apparatus according to claim 20, wherein said driver engine is a "V" model engine.

32. The apparatus according to claim 20, wherein said driver engine is a horizontally opposed cylinder engine.

33. The apparatus according to claim 20, wherein said spring mount set is manufactured from molded rubber.

34. The apparatus according to claim 20, wherein said pivot mechanism is pivotally connected to said engine assembly and said compressor assembly, and wherein said pivot mechanism is comprised of:

a first "U"-shaped brace, comprising two generally triangularly-shaped arms of similar dimensions;

a second "U"-shaped brace, comprising two generally triangularly-shaped arms of similar dimensions; and a bolt and bushing assembly;

wherein said first "U"-shaped brace is fixedly connected to said engine assembly, and wherein said second "U"-shaped brace is fixedly connected to said compressor assembly, and further wherein said first and second "U"-shaped braces are pivotally connected to each other using said bolt and bushing assembly, with said triangularly-shaped arms of said first brace slidably fitting within said triangularly-shaped arms of said second brace, and further wherein each of said triangularly-shaped arms incorporates a horizontally-shaped slot, through which said bolt and bushing assembly is slidably joined to each of said braces, and wherein said nut and bushing assembly further includes a tubular-shaped bushing, preferably manufactured from elastomer material, thereby damping rotation and constraining lateral movement of said engine assembly with respect to said compressor, and further wherein said bolt and bushing assembly comprises a bolt axially positioned through said tubular bushing, and wherein said slot allows for the initial alignment of the driver engine and compressor prior to securing of said bolt and bushing assembly with a nut and a plurality of washers to said bolt, and further wherein said braces are preferably manufactured from steel.

35. The apparatus according to claim 34, wherein said pivot mechanism is manufactured from steel.

36. The apparatus according to claim 20, wherein the fuel for said apparatus is a liquid fuel.

37. A drive system for a separable internal combustion engine-gas compressor apparatus comprising:

a driver engine;

a gas compressor;

a pivot mechanism;

a rear torque control plate;

a compressor pulley;

an engine pulley;

a belt drive; and flywheels;

wherein said pivot mechanism and said rear torque control plate are fixedly connected between said driver engine and said gas compressor, and wherein said engine pulley is movably connected to said compressor pulley by means of said belt drive, and wherein said flywheels are fixedly connected to said pulleys.

38. The apparatus according to claim 37, wherein said drive system is further comprised of a compressor pulley, an engine pulley, a belt drive, and flywheels.

39. The apparatus according to claim 37, wherein said drive system is further comprised of a compressor sprocket, an engine sprocket, a drive chain, and flywheels.

40. The apparatus according to claim 37, wherein said drive system is further comprised of a compressor gear, an engine gear, an idler gear drive, and flywheels.

41. The apparatus according to claim 37, wherein said drive system has a selectable speed ratio option, thereby optimizing a particular combustion engine and gas compressor.

42. The apparatus according to claim 37, wherein said internal combustion engine is a motor.

43. A dampening mechanism for an internal combustion engine-gas compressor apparatus comprising:

a rear torque control plate; and four identical independently operating vibration dampening mechanisms, wherein each of said mechanisms further comprises:

four damping spring mounts; and a plurality of torque control plate connector assemblies, each of said torque plate assemblies further comprising a plurality of nuts and bolts and an "L" shaped angle bracket, wherein said plurality of nuts and bolts fixedly connect said "L" shaped angle bracket to said rear torque control plate and to each of said damped spring mounts, and further wherein a first front spring mount and a first rear spring mount of said damping spring mounts fixedly connect said driver engine to said skid, and a second front spring mount and a second rear spring mount of said damping spring mounts fixedly connect said gas compressor to said skid, and further wherein said plurality of nuts and bolts fixedly connect said spring mounts to said skid and said driver engine and said gas compressor, whereby said damping spring mounts permit vertical and lateral movement of said driver engine and said gas compressor, constraining relative lateral and rotational motion, thereby effectively dissipating torsional and linear vibration forces, and wherein said rear torque control plate is preferably manufactured from steel.

44. A pivot mechanism for an internal combustion engine-gas compressor combination comprising:

an engine assembly;

a compressor assembly;

a first "U"-shaped brace, comprising two generally triangularly-shaped arms of similar dimensions;

a second "U"-shaped brace, comprising two generally triangularly-shaped arms of similar dimensions; and a bolt and bushing assembly;

wherein said first "U"-shaped brace is fixedly connected to said engine assembly, and wherein said second "U"-shaped brace is fixedly connected to said compressor assembly, and further wherein said first and second "U"-shaped braces are pivotally connected to each other using said bolt and bushing assembly, with said triangularly-shaped arms of said first brace slidably fitting within said triangularly-shaped arms of said second brace, and further wherein each of said triangularly-shaped arms incorporates a horizontally-shaped slot, through which said bolt and bushing assembly is slidably joined to each of said braces, and wherein said nut and bushing assembly further includes a tubular-shaped bushing, preferably manufactured from an elastomer material, thereby damping rotation and constraining lateral movement of said engine assembly with respect to said compressor, and further wherein said bolt and bushing assembly comprises a bolt axially positioned through said tubular bushing, and wherein said slot allows for the initial alignment of the driver engine and compressor prior to securing of said bolt and bushing assembly with a nut and a plurality of washers to said bolt, and further wherein said braces are preferably manufactured from steel.

* * * * *

UNITED STATES PATENT AND TRADEMARK OFFICE

CERTIFICATE OF CORRECTION

PATENT NO. : 6,176,690 B1 
DATED : January 23, 2001
INVENTOR(S) : John Evans Knepp It is certified that error appears in the above-identified patent and that said Letters Patent is hereby corrected as shown below:

Title page,
Item [73], Assignee, should read as follows: -- UScomPOWER, Williamsburg, VA --.

Signed and Sealed this

Twenty-fifth Day of June, 2002

*Attest:*

*Attesting Officer*

JAMES E. ROGAN
*Director of the United States Patent and Trademark Office*